US005598818A

United States Patent [19]

Domanchuk

[11] Patent Number: 5,598,818

[45] Date of Patent: Feb. 4, 1997

[54] METHOD OF PROVIDING A CYLINDER BORE LINER IN AN INTERNAL COMBUSTION ENGINE

[75] Inventor: David J. Domanchuk, Grand Haven, Mich.

[73] Assignee: SPX Corporation, Muskegon, Mich.

[21] Appl. No.: 592,459

[22] Filed: Jan. 26, 1996

Related U.S. Application Data

[60] Provisional application No. 60/001,244, Jul. 20, 1995.

[51] Int. Cl. [6] ..... F02B 77/02

[52] U.S. Cl. ..... 123/193.2; 123/668

[58] Field of Search ..... 123/193.2, 668, 123/669; 29/888.06, 888.061; 164/46; 266/202; 75/338; 428/35.8

[56] References Cited

U.S. PATENT DOCUMENTS 4,971,846 11/1990 Lundy ..... 428/35.8

*Primary Examiner*—Marguerite McMahon

*Attorney, Agent, or Firm*—Barnes, Kisselle, Raisch, Choate, Whittemore & Hulbert, P.C.

[57] ABSTRACT

A method of making an engine block for an internal combustion engine comprising making an engine block with cylinder bores, forming a spray-formed cylinder liner with a predetermined internal diameter and a predetermined external diameter, heating the cylinder block, inserting the cylinder liner in the bore, and permitting the cylinder block to cool such that the liner is locked in position in the bore by compressive forces. The spray-formed cylinder liner comprises a cylindrical body made of a material having predetermined thermal characteristics, wear resistant and scuff resistant materials. The cylindrical body has an external surface formed by spray forming and an internal surface formed by spray forming. The liner can have a single spray-formed layer or multiple spray-formed layers of different materials.

13 Claims, 2 Drawing Sheets

METHOD OF PROVIDING A CYLINDER BORE LINER IN AN INTERNAL COMBUSTION ENGINE

This application claims the benefit of U.S. Provisional application No. 60/001,244 filed Jul. 20, 1995.

This invention relates to internal combustion engines and particularly to internal combustion engine blocks with liners.

BACKGROUND AND SUMMARY OF THE INVENTION

Automotive engine blocks are typically produced from cast iron or aluminum materials. Cast iron engine blocks are very durable and wear resistant but have the disadvantage of excessive weight. Aluminum engine blocks have the advantage of being light-weight but have the disadvantage of having poor wear and scuff resistance between the piston and rings and the mating cylinder wall. To improve wear and scuff resistance, several techniques have been used in aluminum engine blocks. The installation of cast iron cylinder liners is one technique; however, extensive machining is required to both the engine block and cylinder liner so that they fit together properly. It is also known to cast the aluminum block around a cast iron liner but this adds complexity to the casting process. Additionally, cast iron liners have the disadvantage of adding weight to the aluminum engine block. Another technique is to cast the entire aluminum block out of a high-silicon aluminum alloy. This material has excellent wear resistance but is difficult to machine and difficult to cast.

Still another technique is to cast the aluminum block out of a lower-silicon content aluminum alloy and apply a plating to the bore of the block or aluminum alloy liner to improve wear resistance. The plating is typically a nickel alloy with a controlled fine dispersion of silicon carbide or boron nitride particles distributed uniformly in the metal matrix. Plating has the disadvantage of having long cycle times and high material costs.

A further technique is to provide a thermal sprayed coating on the bore of an aluminum block that offers wear and scuff resistant properties of a cast iron liner. Thermal spraying of coatings directly on the bore has the following disadvantages:

1. Requires surface preparation of the bore prior to thermal spraying to provide a roughened surface for adhesion or bonding of the sprayed coating.

2. Periodic bond testing of coatings (which is required to insure adhesion) are typically destructive in nature and would require scrapping of the engine block.

3. Extensive masking of the engine block is required to ensure that over-spray does not come in contact with other machined surfaces.

4. Periodic checks of coating microstructure and thickness are typically destructive in nature and like the bond testing, would require scrapping of the engine block.

5. Requires preheating of the cylinder wall surfaces by flowing hot water through the engine coolant passages prior to thermal spraying, then cooling the casting during the metal spray application so as to prevent thermal damage to the casting.

6. Requires that the engine block casting be supported in a special fixture that seals the cooling passage openings to permit the flow of water through the casting.

Among the objectives of the present invention are to provide a method of making engine blocks with liners which overcomes the disadvantages of present methods; to provide an improved engine block; and to provide an improved liner.

It is a further object of this invention to provide a spray-formed liner that is light-weight when compared to cast iron liners typically used in cast aluminum blocks.

It is a further object of the present invention to provide a spray-formed cylinder bore liner for cast aluminum engines. The spray-formed liner provides wear and scuff resistance between the piston, piston rings and cylinder wall.

It is a further object of this invention to provide a spray-formed liner that requires no additional processing of the outer diameter after the thermal spray-forming of the liner. The process of thermal spray-forming a liner comprises spraying the internal diameter of a tube machined to a predetermined diameter. This results in a smooth outside diameter ready for assembly. The smooth outside diameter provides excellent heat transfer to the aluminum bore of the engine block.

Still another object of this invention is to provide a spray-formed liner that has unlimited material possibilities. The spray-formed liners are produced by a thermal spray process. Any material that can be produced in a powder or wire form for use in a thermal spray process has the potential to be used in a spray-formed liner. Material examples are metallic alloys, pure metals, clad composites, and cermets.

Yet another object of this invention is to provide a spray-formed liner that has a dual layer combination of materials. For example, an outer layer of a given material could be used on the spray-formed liner that provides excellent heat transfer while an inner layer of a given material could be used to provide wear and scuff resistance.

Still a further object of this invention is to provide a spray-formed liner that has a bonding agent or adhesive applied to the outer diameter.

In one method of assembly for the spray-formed liner the aluminum block is preheated to expand the bore of the engine block for insertion of the spray-formed liner. The block is then cooled, creating a shrink fit or compression fit around the spray-formed liner, locking it in place. Differences in coefficient of thermal expansion between the liner and aluminum bore could result in a reduced compression fit during hot engine running. In such a situation, the addition of an adhesive or bonding agent may be required to enhance the locking of the liner to the bore of the aluminum block.

DESCRIPTION OF THE PREFERRED EMBODIMENTS

Figure 1:
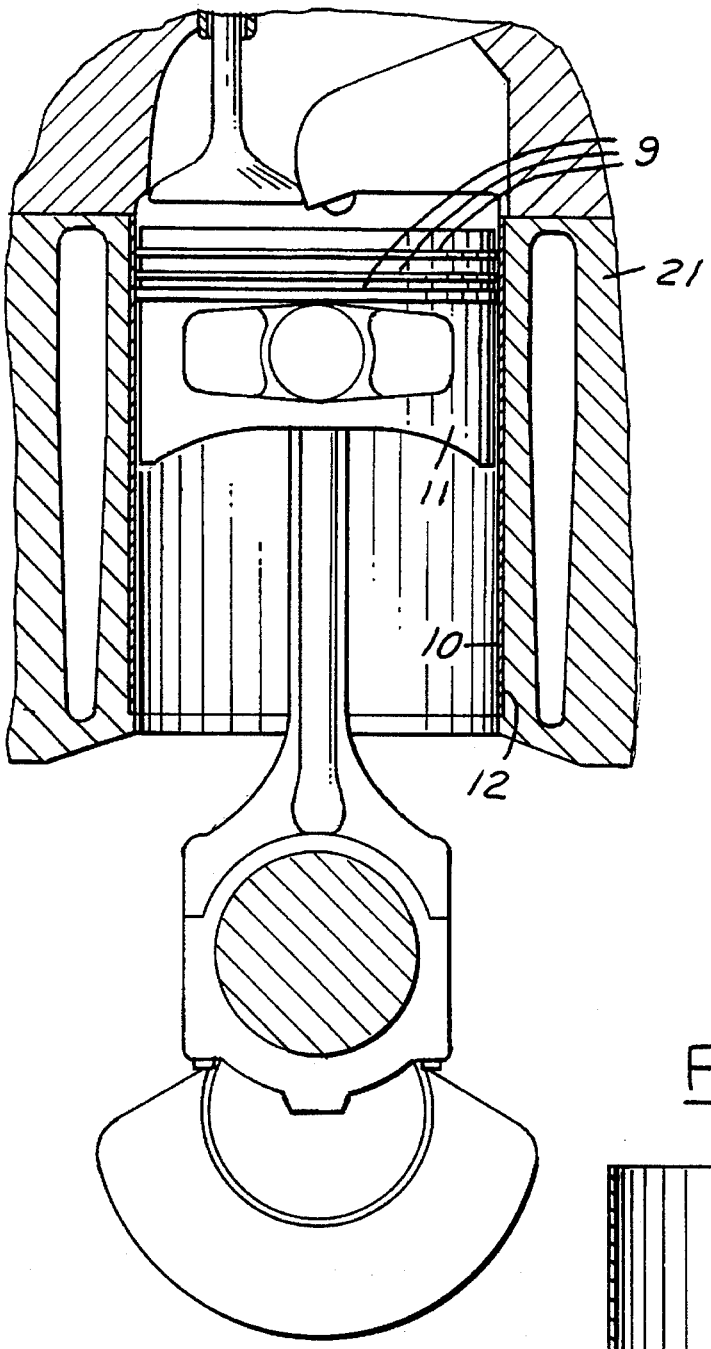
FIG. 1 is a cross-sectional illustration of an internal combustion engine containing spray-formed cylinder liner in one cylinder bore.
Figure 3:
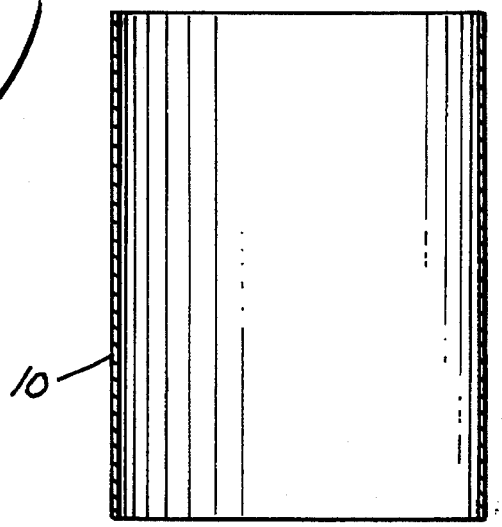
FIG. 3 is a cross-sectional view of thin-walled spray-formed cylinder liner.

In accordance with the invention as shown in FIG. 1, a thin-walled spray-formed cylinder bore liner 10 is provided in the internal combustion engines. The spray-formed liner 10 provides a wear and scuff resistant surface between the piston 11, piston rings 9 and the bore 12 of the engine block.

Figure 2:
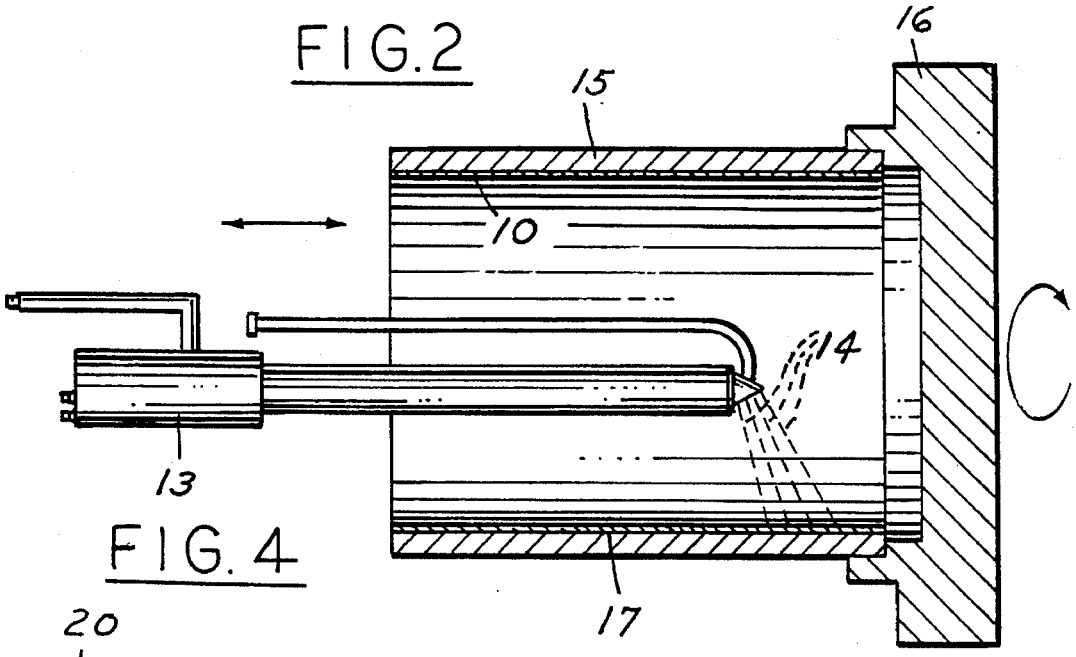
FIG. 2 is a view of a thermal spray gun depositing material to the I.D. of a tube mold mounted to a rotating fixture shown in cross-section.

Spray-forming is the fabrication of structural parts by a thermal spray process. Plasma spraying is the preferred thermal spray technique used in the fabrication of the spray-formed liner 10 (FIG. 2). With the use of a plasma gun 13, powdered materials 14 are injected into a hot gas plasma where they are heated and accelerated to the internal surface of a reusable tube mold 15. The tube mold 15 and plasma gun 13 are rotated relative to one another about the axis of the tube mold. The tube mold 15 and plasma gun 13 traverse axially relative to one another to apply a layer of material to the inner surface of the tube mold 15 such that when the material solidifies, a unitary spray-formed liner 10 is formed. This liner 10 can be removed from the mold, machined to length, and inserted in the bore of an engine block, as presently described. The liner 10 is formed on the inner surface of the tube mold by the accumulation of molten and semi-molten particles. The tube mold 15 is preferably mounted on a fixture 16 that rotates at a fixed RPM. The plasma gun 13 then traverses axially in and out of the tube mold 15 while it rotates, applying material to the internal surface 17 of the tube mold 15.

The internal surface 17 of the tube mold 15 is machined to a predetermined internal diameter (I.D.) corresponding to a finished liner outer diameter (O.D.). This predetermined diameter of the tube mold 15 is made larger to take into account contraction of the spray-formed liner 10 after cooling. The number of passes the plasma gun makes is calculated based on the material thickness requirements of the spray-formed liner 10; typically about 0.010 to 0.060 inch thick.

The thermally sprayed powdered material can be any suitable material to obtain the desired heat transfer properties, wear properties and scuff resistant properties. Any material that can be produced in a powdered form for plasma spraying has the potential to be spray-formed. Examples are metallic alloys, pure metals, clad composites and cermets. For example, satisfactory materials for a liner to be used with an aluminum engine block are Fe-Cr; Mo-Ni-Cr; Fe-Mo-B-C. Other materials comprise a metal or metal alloy containing solid lubricants.

Figure 4:
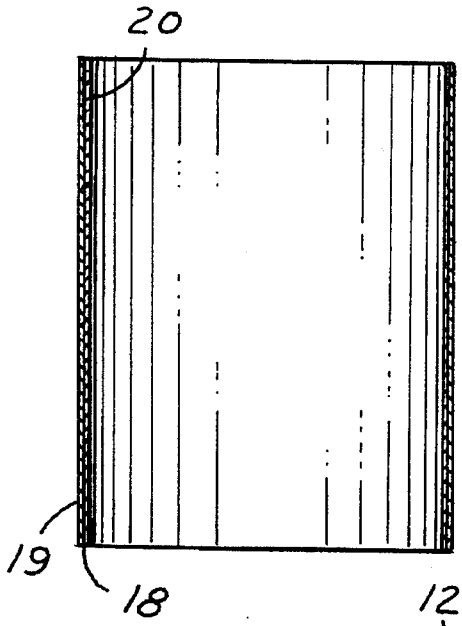
FIG. 4 is a cross-sectional view of a dual-material spray-formed cylinder liner.

Referring to FIG. 4, two different layers can be used in the fabrication of a spray-formed liner 18. For instance, a thin layer of a material 19 that has excellent heat transfer properties is applied first to the internal surface 17 of the tube mold 15, followed by a material 20 that has excellent wear, scuff, and anti-friction characteristics. For example, the outer layer 19 may comprise an aluminum alloy and the inner layer 20 may comprise a Mo-Ni-Cr. Ideally, materials that are low cost in nature but provide wear and scuff properties are best suited for spray formed liners.

Although the fabrication of the spray-formed liner in this invention is preferably made by the use of a plasma gun, it is not limited in scope only to this type of gun. High-velocity oxy-fuel, dual wire arc, and plasma transfer wire arc are some of the different types of thermal spray guns that can be used. Additionally, some of these systems use materials that are supplied to the gun in the form of wire. Like powdered materials, any material that is typically applied in the form of wire has the potential for use in spray-formed liners.

After the proper material thickness has been applied to the I.D. of the tube mold 15, the tube mold 15 is cooled allowing the spray-formed liner 10 to contract and separate from the tube mold 15 for ease of removal.

After removal of the spray-formed liner 10 from the tube mold 15, a post machining operation may need to be performed to square up the ends of the spray-formed liner. This can be achieved by fixturing the liner on a mandrel and have a small portion of each end cut off with a high-speed Borazon or diamond wheel.

After fabrication and machining of the spray-formed liner 10, it is ready for assembly in the bore of the engine block.

One of the unique features in the spray-forming of liners by spraying the I.D. of a tube mold 15 is that a smooth, completely finished outside diameter is created. No additional processing of the liner O.D. is required prior to assembly. The smooth O.D. is a requirement for proper heat transfer to the aluminum block.

Figure 5:
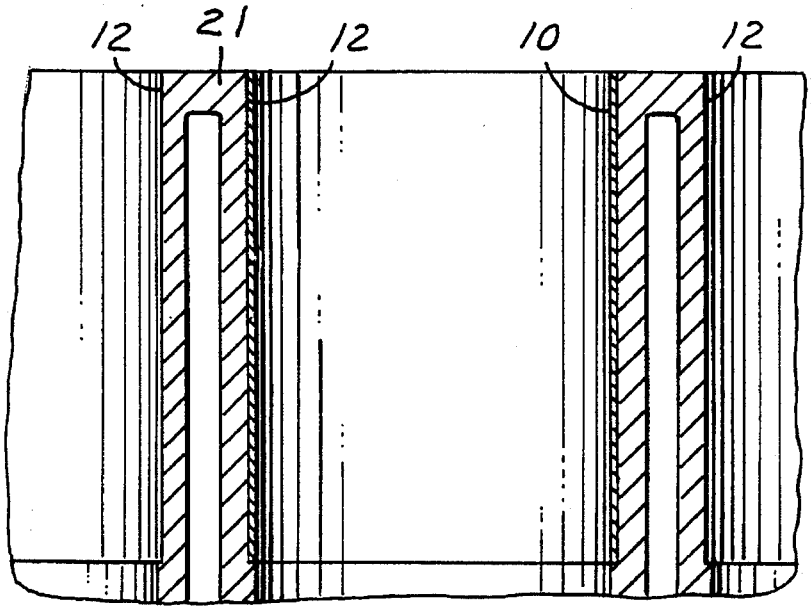
FIG. 5 is a cross-sectional view of spray-formed cylinder liner assembled in a machined cylinder bore of an engine block.

Referring to FIG. 5, the actual assembly of the spray-formed liner 10 requires that the cylinder bores 12 of the block 21 be machined to a predetermined diameter. This diameter is calculated so that when the aluminum block is heated to a predetermined temperature, the bore expands to a diameter larger than the finished outer diameter of spray-formed liner 10. The liner can then be inserted in the bore 12 of the engine block 21. The block 21 is then cooled to room temperature creating a shrink fit or compression fit around the spray-formed liner 10, locking it into place.

In addition, differences in coefficients of thermal expansion between the liner and aluminum bored block may result in reduced compression fit during hot engine operation. It may be necessary to apply an adhesive or bonding agent to the O.D. surface of the spray-formed liner 10 to enhance the locking of the liner to the bore of the aluminum block. Ideally, the spray-formed liner material should have thermal expansion properties closely matching those of the aluminum block to minimize the likelihood of reduced compression fit during hot engine operation. In addition, after insertion of the liner in the engine block, the I.D. of the liner is machined by honing in situ while it is in place to the bore. The compressive forces holding the liner in place are higher than the honing forces required to machine the I.D. of the liner after insertion in the block. Should the compressive forces not be high enough to overcome the honing forces, the spray-formed liner would spin in the bore. This spinning would render the block useless, causing it to be scrapped. The addition of an adhesive or bonding agent minimizes the likelihood of spinning occurring.

Following the insertion of the spray-formed liner, the engine block can be moved to the honing operation. This operation removes an amount of material from the I.D. of the spray-formed bore until a predetermined bore size is achieved. The engine block is now ready for further assembly of engine components.

The following examples are exemplary of the invention:

| Example I | |
|---|---|
| tube material | brass |
| liner material | Fe—Cr |
| engine block material | 319 Aluminum |
| sprayed thickness of liner | .040 |

It can thus be seen that there has been provided a spray-formed liner that is light in weight and provides desired wear resistance and scuff resistance; which requires no additional processing of the outer diameter after it is made; and which is made by a method that results in a uniform wall thickness.

What is claimed is:

1. The method of making an engine block for an internal combustion engine comprising making an engine block with cylinder bores, forming a spray-formed cylinder liner with a predetermined internal diameter and a predetermined external diameter, heating said cylinder block, inserting the cylinder liner in the bore, and permitting said cylinder block to cool such that said liner is locked in position in the bore by compressive forces.

2. The method set forth in claim 1 including the step of machining the internal diameter of the spray formed cylinder liner to a predetermined diameter.

3. The method set forth in claim 1 including the step of machining said liner comprises honing the internal diameter of the cylinder liner while it is in the block.

4. The method set forth in claim 1 wherein each cylinder liner includes a first spray-formed layer and second spray-formed layer.

5. The method set froth in claim 1 including the step of applying a bonding agent between the cylinder bore and the cylinder liner.

6. The method set forth in claim 1 including the step of heating the cylinder block before inserting of the cylinder liner.

7. The method set forth in any one of claims 1–6 wherein the step of forming a spray formed cylinder liner with a predetermined diameter comprises providing a thermal spray gun, providing a tube mold having a predetermined internal diameter, positioning the thermal spray gun axially within the tube mold and rotating the tube mold relative to the thermal spray gun and simultaneously directing material through the spray gun while reciprocating the spray gun along the axis of the tube mold until a layer of material of desired thickness is applied to the tube mold.

8. A spray-formed cylinder liner comprising a cylindrical body made of a material having predetermined thermal characteristics, wear resistant and scuff resistant materials, said cylindrical body having an external surface formed by spray forming, said cylindrical body having an internal surface formed by spray forming.

9. The spray-formed cylinder liner set forth in claim 8 wherein said liner comprises a single spray-formed layer.

10. The spray-formed cylinder liner set forth in claim 8 wherein said liner comprises multiple spray-formed layers of different materials.

11. An aluminum engine block comprising an aluminum engine block having cylindrical bores, a spray-formed cylinder liner in each said bore, each cylinder liner comprising a cylindrical body made of a material having predetermined thermal characteristics, wear resistant and scuff resistant materials, said cylindrical body having an external surface formed by spray forming, said cylindrical body having an internal surface formed by spray forming, each said cylinder liner being held in its respective bore by compressive forces between said engine block and said liner.

12. The engine block and spray-formed cylinder liner set forth in claim 11 wherein each said liner comprises a single spray-formed layer.

13. The engine block and spray-formed cylinder liner set forth in claim 11 wherein each said liner comprises multiple spray-formed layers of different materials.

* * * * *